US009930963B2

(12) United States Patent
Guizzardi

(10) Patent No.: US 9,930,963 B2
(45) Date of Patent: Apr. 3, 2018

(54) MODULAR SHELVING SYSTEM WITH HIGHLY FLEXIBLE USE

(71) Applicant: TERRY STORE-AGE S.p.A., Milan (IT)

(72) Inventor: Massimo Guizzardi, Milan (IT)

(73) Assignee: TERRY STORE-AGE S.P.A., Milan (IT)

( * ) Notice: Subject to any disclaimer, the term of this patent is extended or adjusted under 35 U.S.C. 154(b) by 138 days.

(21) Appl. No.: 14/440,763

(22) PCT Filed: Sep. 16, 2014

(86) PCT No.: PCT/EP2014/069688
§ 371 (c)(1),
(2) Date: May 5, 2015

(87) PCT Pub. No.: WO2015/165551
PCT Pub. Date: Nov. 5, 2015

(65) Prior Publication Data

US 2016/0286956 A1 Oct. 6, 2016

(30) Foreign Application Priority Data

May 2, 2014 (IT) ..... MI20140159 U

(51) Int. Cl.
*A47B 91/00* (2006.01)
*A47B 91/02* (2006.01)
(Continued)

(52) U.S. Cl.
CPC ..... *A47B 91/026* (2013.01); *A47B 47/0083* (2013.01); *A47B 57/06* (2013.01)

(58) Field of Classification Search
CPC .... A47B 91/026; A47B 47/0083; A47B 57/06
(Continued)

(56) References Cited

U.S. PATENT DOCUMENTS 1,265,373 A * 5/1918 Philip ..... A47B 57/26 108/106
2,476,381 A * 7/1949 Peavey ..... A47B 91/026 248/188.4

(Continued)

FOREIGN PATENT DOCUMENTS

CH 543009 10/1973
DE 20107472 8/2001

OTHER PUBLICATIONS

International Search Report and the Written Opinion dated Dec. 10, 2014, which issued during prosecution of International Application No. PCT/EP2014/069688, which corresponds to the present application.

*Primary Examiner* — Joshua J Michener
*Assistant Examiner* — Devin Barnett
(74) *Attorney, Agent, or Firm* — Troutman Sanders LLP

(57) ABSTRACT

The modular shelving system with highly flexible use has at least one first module having supporting feet of a bottom shelf and a top shelf connected to one another by uprights, said feet comprising adjustment means for the perfectly horizontal arrangement of said bottom shelf and said top shelf so that each of said uprights is loaded with a peak or axial load so as to obtain a capacity of said shelving system that is substantially equal to the nominal design load thereof.

8 Claims, 8 Drawing Sheets

(51) Int. Cl.
*A47B 47/00* (2006.01)
*A47B 57/06* (2006.01)

(58) Field of Classification Search
USPC ..... 211/134, 186, 187, 188; 108/106, 107, 108/110, 180, 147.12–147.15; 52/126.1, 52/126.36, 126.4, 126.5, 126.6, 126.7
See application file for complete search history.

(56) References Cited

U.S. PATENT DOCUMENTS 2,944,780 A * 7/1960 Monk ..... A47B 87/0223 108/186
3,222,030 A * 12/1965 Thorpe ..... E04F 15/02452 248/354.3
3,229,822 A * 1/1966 Janus ..... A47B 57/04 211/134
3,280,767 A * 10/1966 Kahn ..... A47B 57/26 108/147.13
3,324,613 A * 6/1967 Duboff ..... A47B 96/1425 248/200.1
3,387,713 A * 6/1968 Brooks ..... A47B 47/04 211/188
3,470,663 A * 10/1969 Tate ..... E04F 15/02482 248/188.3
3,570,798 A * 3/1971 Squibb ..... A47B 96/1441 108/108
3,664,274 A * 5/1972 Bustos ..... A47B 57/265 108/107
3,684,285 A * 8/1972 Kane ..... A63F 3/00214 211/188
3,705,654 A * 12/1972 Barrineau, III ..... A47F 5/13 108/110
3,771,466 A * 11/1973 Ferdinand ..... A47B 96/1425 108/109
3,783,801 A * 1/1974 Engman ..... A47B 87/0215 108/190
4,023,505 A * 5/1977 Fleck ..... A47B 57/08 108/110
4,128,064 A * 12/1978 Chung ..... A47B 57/265 108/147.13
4,138,953 A * 2/1979 Tashman ..... A47B 57/265 108/147.13
4,158,336 A * 6/1979 Brescia ..... A47B 87/0215 108/156
4,244,156 A * 1/1981 Watts, Jr. ..... E02D 5/226 264/46.5
4,277,923 A * 7/1981 Rebentisch ..... E04F 15/02452 52/126.6
4,290,716 A * 9/1981 Lamy ..... E02B 17/02 405/203
4,319,520 A * 3/1982 Lanting ..... F24F 7/10 454/290
4,359,947 A * 11/1982 Marschak ..... A47B 57/04 108/1
4,404,780 A * 9/1983 Josephson ..... E04B 1/34352 248/357
4,501,512 A * 2/1985 Hiltz ..... F16B 12/18 403/170
4,527,490 A * 7/1985 Tipton ..... A47B 57/265 108/108
4,593,826 A * 6/1986 Bustos ..... A47B 57/265 108/147.12
4,615,278 A * 10/1986 Cabrelli ..... A47B 57/265 108/147.13
4,763,796 A * 8/1988 Flum ..... A47F 1/12 108/187
4,763,799 A * 8/1988 Cohn ..... A47B 31/00 108/147.13
4,799,818 A * 1/1989 Sudimak ..... A47B 57/545 108/147.13
4,843,975 A * 7/1989 Welsch ..... A47B 96/021 108/192
4,881,353 A * 11/1989 Braendel ..... E04H 1/1266 49/237
4,940,150 A * 7/1990 Spengler ..... A47B 87/0223 211/133.1
4,995,204 A * 2/1991 Kelso ..... E04B 1/0007 405/230
5,127,342 A * 7/1992 Taylor ..... A47B 57/265 108/147.13
5,158,187 A * 10/1992 Taub ..... F16B 12/20 108/185
5,174,200 A * 12/1992 Jeandel ..... A47B 47/024 108/107
5,183,167 A * 2/1993 Cheng ..... A47B 57/54 108/147.13
5,207,037 A * 5/1993 Giles ..... E04B 2/7425 52/126.4
5,218,914 A * 6/1993 Dickinson ..... A47B 87/0223 108/186
D338,792 S * 8/1993 Chap ..... D30/120
5,271,337 A * 12/1993 Kolvites ..... A47B 47/04 108/107
5,303,645 A * 4/1994 Meacham ..... A47B 57/545 108/147.13
5,390,803 A * 2/1995 McAllister ..... A47B 57/265 108/147.13
5,421,273 A * 6/1995 Lin ..... A47B 3/04 108/180
5,501,754 A * 3/1996 Hiraguri ..... E04F 15/02476 156/71
5,676,263 A * 10/1997 Chang ..... A47B 57/26 108/147.13
5,706,741 A * 1/1998 Thorp ..... A47B 47/05 108/153.1
5,709,158 A * 1/1998 Wareheim ..... A47B 96/021 108/180
5,779,070 A * 7/1998 Dickinson ..... A47B 57/265 211/181.1
5,881,653 A * 3/1999 Pfister ..... A47B 87/0223 108/147.13
5,909,863 A * 6/1999 Mansfield ..... A47B 96/1433 108/91
5,960,968 A * 10/1999 Wang ..... A47B 57/545 108/147.13
5,964,163 A * 10/1999 Cohen ..... A47B 49/004 108/186
5,964,360 A * 10/1999 Hwang ..... A47B 87/0215 211/186
5,971,175 A * 10/1999 Bustos ..... A47F 5/13 211/187
6,062,150 A * 5/2000 Sikora ..... A47B 87/0223 108/190
6,123,033 A * 9/2000 Polley ..... A47B 46/005 108/107
6,241,108 B1 * 6/2001 Nakatani ..... A47B 57/265 108/108
6,260,488 B1 * 7/2001 Yang ..... A47B 57/545 108/107
6,357,611 B1 * 3/2002 Chen ..... A47B 57/26 108/107
6,363,685 B1 * 4/2002 Kugler ..... E04F 15/02183 52/126.6
6,364,138 B1 * 4/2002 Chen ..... A47B 57/26 108/147.13
6,695,156 B1 * 2/2004 Wang ..... A47B 57/265 108/147.11
7,186,050 B2 * 3/2007 Dean ..... F16B 7/025 403/344
7,210,557 B2 * 5/2007 Phillips ..... E04F 15/20 181/207
7,386,960 B2 * 6/2008 Molteni ..... E04B 2/7433 160/135
7,921,612 B2 * 4/2011 Knight, III ..... B23Q 1/0054 248/188.4
7,984,680 B1 * 7/2011 Tsai ..... A47B 87/0223 108/186

(56) References Cited

U.S. PATENT DOCUMENTS 7,992,730 B2 * 8/2011 Huang ..... A47B 57/265 108/147.13
8,215,245 B2 * 7/2012 Morrison ..... F16F 1/3732 108/91
8,267,262 B2 * 9/2012 Thelwell ..... B65G 1/02 211/183
8,459,476 B2 * 6/2013 Malekmadani .... A47B 87/0223 211/134
8,627,966 B2 * 1/2014 Jarvis ..... A47B 55/00 211/187
8,678,207 B2 * 3/2014 Shimazaki ..... A47B 57/545 108/147.13
2002/0046982 A1 4/2002 Guizzardi
2002/0092818 A1 * 7/2002 Craft ..... A47B 96/021 211/188
2002/0113180 A1 * 8/2002 Wiebe ..... A47B 57/265 248/188
2003/0131767 A1 * 7/2003 Chen ..... A47B 57/265 108/147.13
2004/0065633 A1 * 4/2004 Chen ..... A47F 5/13 211/187
2004/0173551 A1 * 9/2004 Wu ..... A47B 57/54 211/187
2005/0199160 A1 * 9/2005 Ching-Po ..... A47B 57/265 108/107
2006/0283824 A1 * 12/2006 Farley ..... F17C 13/085 211/188
2007/0267371 A1 * 11/2007 Farley ..... A47B 47/0083 211/85.18
2008/0061019 A1 * 3/2008 Lin ..... A47B 47/0083 211/187
2008/0156759 A1 * 7/2008 Lai ..... A47B 87/0207 211/187
2008/0222973 A1 * 9/2008 Lee ..... E04F 15/02476 52/126.1
2009/0173018 A1 * 7/2009 Buzon ..... E04F 15/0247 52/126.6
2009/0188178 A1 * 7/2009 Lucas ..... E04H 4/144 52/126.1
2009/0278003 A1 * 11/2009 Chiang ..... A47B 91/026 248/188.4
2010/0096352 A1 * 4/2010 Wang ..... A47B 47/045 211/187
2010/0108631 A1 * 5/2010 McAllister ..... A47B 57/545 211/187
2011/0036278 A1 * 2/2011 Karl ..... A47B 57/545 108/147.13
2011/0036798 A1 * 2/2011 Chen ..... A47B 47/0008 211/188
2011/0252722 A1 * 10/2011 Laurin ..... E02D 27/32 52/126.6
2012/0298607 A1 11/2012 Chen
2013/0104464 A1 * 5/2013 Meyer ..... E04F 15/02458 52/126.6
2014/0261107 A1 * 9/2014 Sabounjian ..... A47B 57/10 108/147.13
2015/0060621 A1 * 3/2015 Sabounjian ..... F16B 12/42 248/243
2016/0015174 A1 * 1/2016 Guizzardi ..... A47B 87/0223 211/186
2016/0037915 A1 * 2/2016 Fu ..... A47B 57/545 211/187
2016/0198847 A1 * 7/2016 Fu ..... A47B 57/34 211/187

* cited by examiner

MODULAR SHELVING SYSTEM WITH HIGHLY FLEXIBLE USE

CROSS-REFERENCE TO RELATED APPLICATIONS

This Application is the National Stage of International Application No. PCT/EP2014/069688 filed Sep. 16, 2014. This application has not yet published. The International Application claims priority to Italian Application No. MI2014 U000159 filed May 2, 2014. The subject matter of the above application are incorporated herein by reference.

FIELD OF THE INVENTION

The present invention relates to a modular shelving system with highly flexible use.

BACKGROUND

Plastic modular shelving has been available on the market for some time comprising plastic shelves and plastic uprights and modular metal shelving comprising sheet metal shelves and uprights and other sheet metal components.

Such modular shelving systems have usually a plurality of modules having bottom shelves, middle shelves and top shelves that can be assembled in various configurations.

The advantage provided by a modular shelving system lies in the fact that the user can assemble the modules of the shelving system as they prefer and particularly according to the available space where the shelving system must be placed. Therefore, the modules can be assembled on top of one another so as to make a shelving system with a vertical extension especially in a room with a very high ceiling or the modules can be placed alongside one another to make a shelving system with a horizontal extension.

In the event that a shelving system is made with modules alongside one another, the user can decide on the number of shelves that each module can have. Therefore, a shelving system can be made having for example a first module with three shelves (a bottom shelf, a middle shelf and a top one), supported by the relative uprights, alongside a second module with only two shelves (a bottom one and a top one).

In this configuration, the top shelf of the first module and the top shelf of the second module are not coplanar with one another but are staggered in height by an amount equal to the thickness of the middle shelf interposed between two adjacent lengths of the uprights.

The two modules therefore have different heights and are aesthetically unpleasing and functionally the presence of a step between one module and the other is a drawback.

The task of the present invention is, therefore, that of eliminating the drawbacks complained of in the prior art.

SUMMARY

Within the scope of this task an object of the invention is to make a simple, aesthetically pleasing, modular shelving system, which has a suitable loading capacity, is easy to assemble and disassemble and is safe for the user both during use and during assembly and disassembly.

A further object of the invention is to make a modular shelving system that can have shelves arranged perfectly horizontally and parallel to the support plane in any mode of composition of the modules.

The task as well as these and other objects, according to the present invention, are reached by making a modular shelving system, with highly flexible use, having at least one first module having supporting feet of a bottom shelf and a top shelf connected to one another by uprights, characterised in that said feet comprise adjustment means for the perfectly horizontal arrangement of said bottom shelf and said top shelf so that each of said uprights is loaded with a peak or axial load so as to obtain a capacity of said shelving system that is substantially equal to the nominal design load thereof.

Advantageously the shelving system comprises alongside said first module at least a second module having supporting feet of a bottom shelf and a top shelf connected to one another by uprights.

In particular, the adjustment means of said feet make said top shelf of said first module and said top shelf of said second module perfectly coplanar with one another when in said first or second module there is a middle shelf between said bottom shelf and said top shelf.

In particular the adjustment means comprise a truncated cone element adapted to be placed on a support plane and a cylindrical element adapted to engage said truncated cone element with a first end and adapted to engage said uprights with a second end.

Advantageously the second end of said cylindrical element is engaged with an annular flange internal to through holes in said bottom shelves.

Preferably the flange is clamped between the second end and an external shoulder of the uprights.

Preferably the truncated cone element has an internal thread corresponding to half a turn of a screw.

Preferably the first end of said cylindrical element has an external counter-thread adapted to be screwed with said thread.

Preferably the truncated cone element has a plurality of external non-slip ribs adapted to facilitate its grip.

The adjustment means may comprise an adaptor ring for adapting the dimensions of the diameter of said cylindrical element to the dimensions of the diameter of said through holes present in said bottom shelves.

Advantageously the cylindrical element and the ring have mutual retaining means.

In particular the retaining means comprise a plurality of housing seats positioned outside said cylindrical element and a plurality of protuberances positioned on a surface of said ring in contact with said cylindrical element.

Advantageously said ring and said uprights have mutual retaining means of exactly the same type as the mutual retaining means provided between the ring and the cylindrical element.

Preferably the ring has a cut parallel to its axis along the whole length of its wall adapted to facilitate the elastic engagement of said protuberances with said housing seats.

More in particular, the ring has a collar connected thereto with a lateral surface adapted to give greater strength to said collar for supporting said bottom shelves.

BRIEF DESCRIPTION OF THE DRAWINGS

Further characteristics and advantages will become more apparent from the following detailed description of the shelving system according to the invention, illustrated by way of non-limiting example in the accompanying figures, wherein.

DETAILED DESCRIPTION

Figure 1:
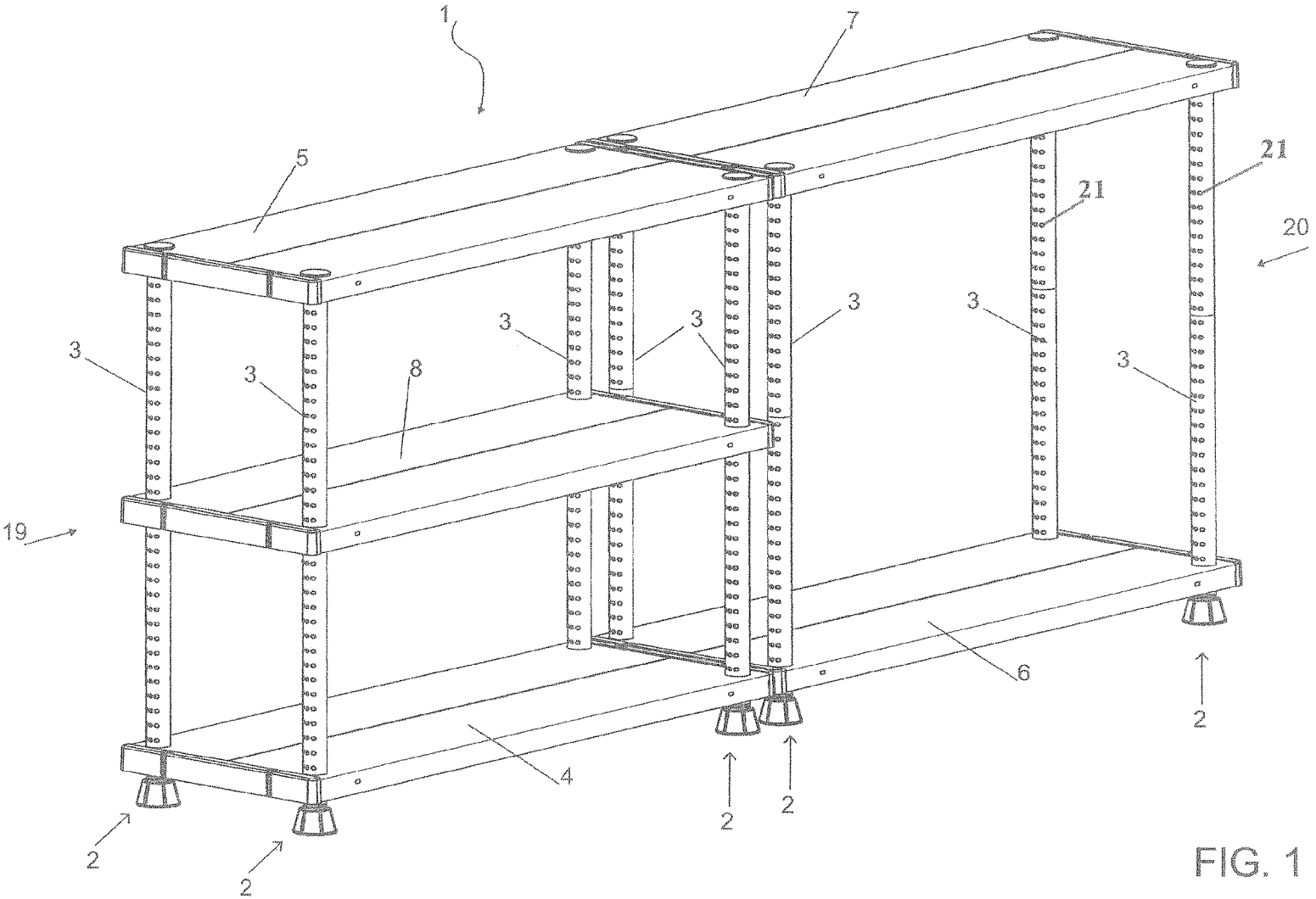
FIG. 1 shows a perspective view of the shelving system assembled with the first module alongside the second module.

With reference to the figures mentioned, a modular shelving system is shown indicated overall with the reference number 1.

The shelving system 1 comprises a first module 19 having supporting feet 2 of a bottom shelf 4 and a top shelf 5 connected to one another by uprights 3 which are made of modular lengths.

The feet 2 advantageously comprise adjustment means for the perfectly horizontal arrangement of the bottom shelf 4 and the top shelf 5 so that each of the uprights 3 is loaded with a peak or axial load so as to obtain a capacity of the shelving system 1 substantially equal to the nominal design load thereof.

The shelving system further comprises at least a second module 20 that can be assembled above the first module 19 or that, as shown in FIG. 1, is alongside the first module 19.

The second module 20 has supporting feet 2 of a bottom shelf 6 and a top shelf 7 connected to one another by uprights 3.

The adjustment means for adjusting the feet 2, as well as giving stability to the shelving system, allow the top shelf 5 of the first module 19 to be made completely coplanar with the top shelf 7 of the second module 20 when in the first or second module 19 and 20 there is a middle shelf 8 between the bottom shelf 4, 6 and the top shelf 5,7.

Figure 2:
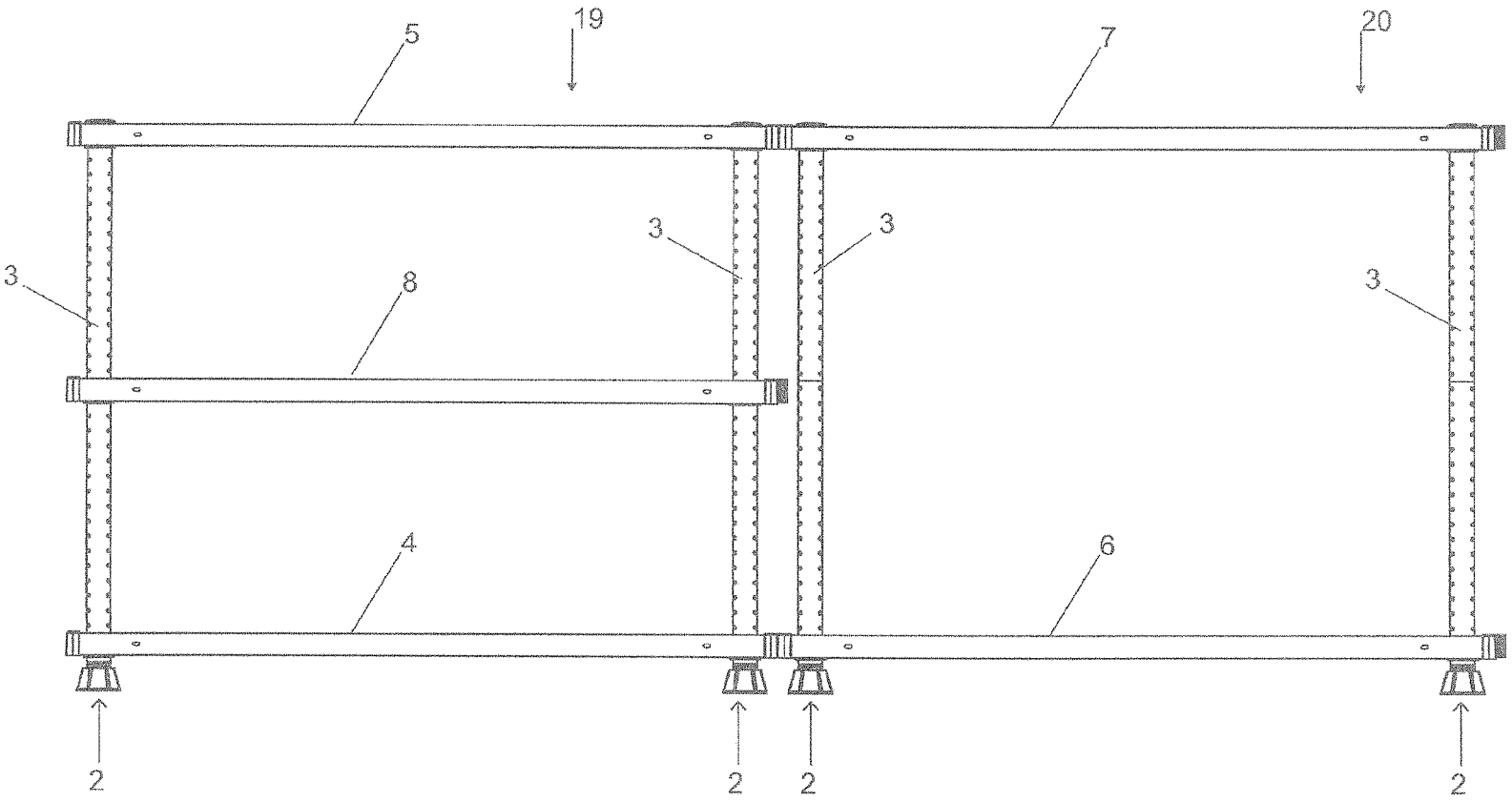
FIG. 2 shows a front view of the shelving system of FIG. 1.
Figure 3:
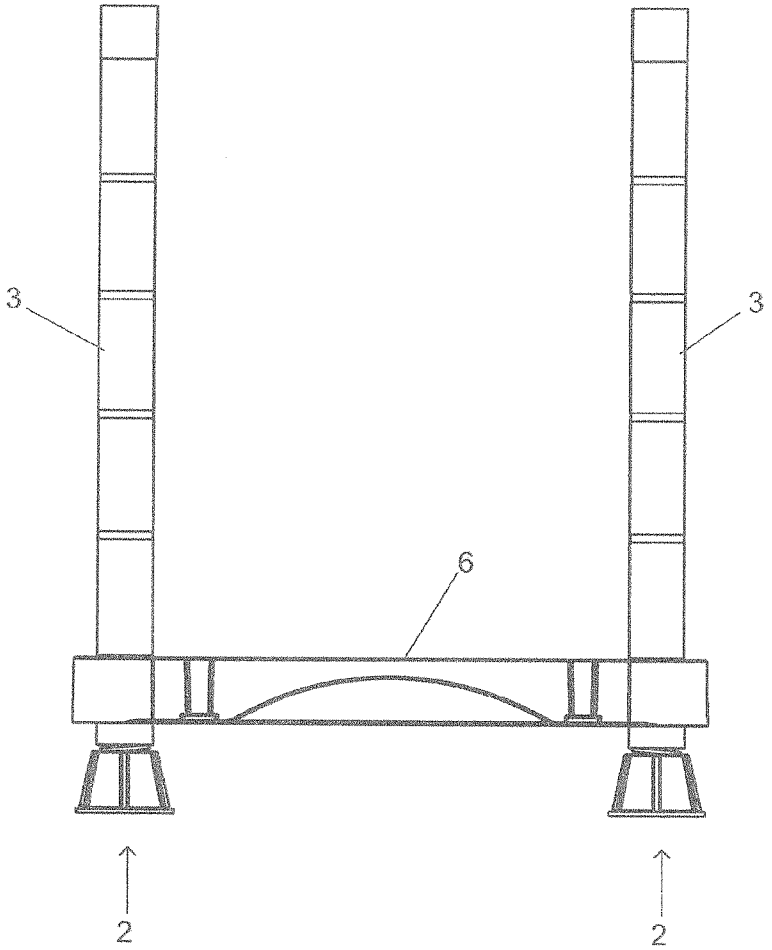
FIG. 3 shows a lateral view of the second module of the shelving system with the bottom shelf supported by the uprights and by the feet.
Figure 4:
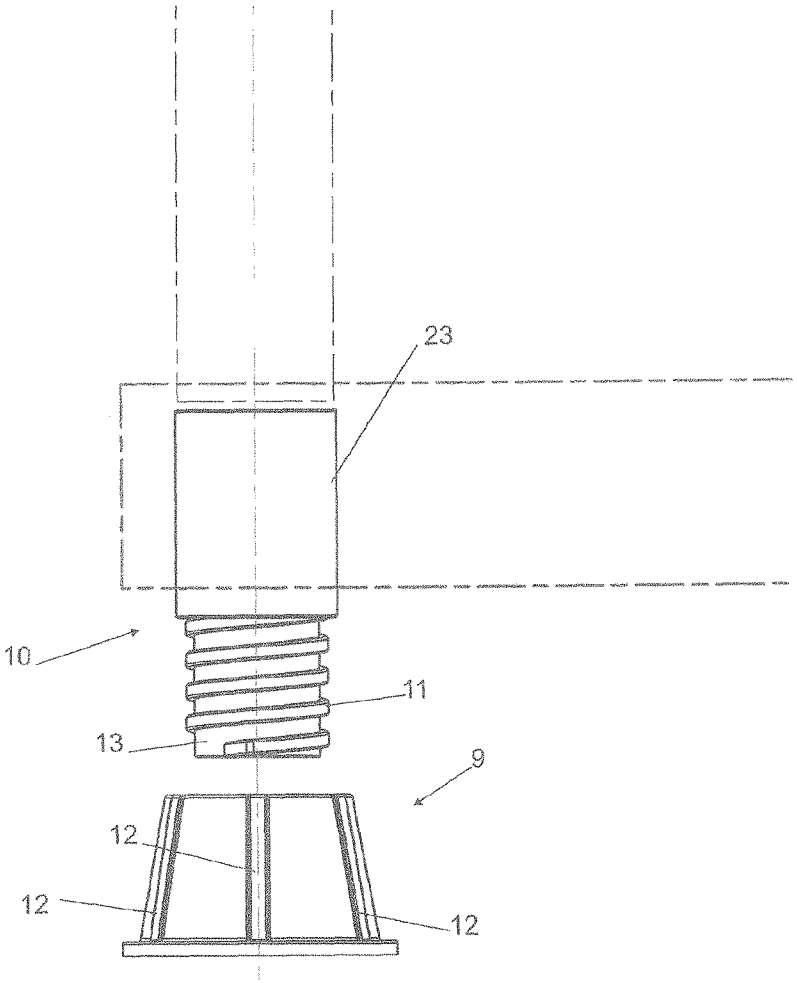
FIG. 4 shows a detail of the adjustment means of the feet of the shelving system.

In the minimum configuration, shown by way of example in FIGS. 1 and 2, the first module 19 has the bottom shelf 4, a middle shelf 8 and a top shelf 5, while the second module only has the bottom shelf 6 and the top shelf 7. The lack of the middle shelf in the second module reduces the overall height of the second module due to the lack of thickness given by the shelf itself between the uprights that are directly connected to one another. In fact, the top shelves 5 and 7 of the first module 19 and of the second module 20 are staggered in height by an amount equal to the thickness of the middle shelf 8 that is interposed between two adjacent lengths of the uprights 3.

Thanks to the presence of the adjustment means the user can adjust the height of the second module 20 so that its top shelf 7 is coplanar with the top shelf 5 of the first module 19.

In fact, to allow this possibility, the adjustment means comprise a truncated cone element 9 adapted to rest on a support plane and a cylindrical element 10 adapted to engage the truncated cone element 9 with a first end 13 and adapted to engage the uprights 3 with a second end 23.

In particular the uprights 3 are made of modular lengths. Each length has, at one end, an external shoulder 30 adapted to be engaged by said end 23 of said cylindrical element 10.

The truncated cone element 9 has an internal thread 15 corresponding to half a turn of a screw.

The first end 13 of the cylindrical element 10 has an external counter-thread 11 adapted to be screwed with the thread 15 of the truncated cone element 9.

In this way, when the user screws or unscrews the cylindrical element and the truncated cone element, he/she reduces or increases the height and adjust the perfect horizontability of the second module 20 so as to make the top shelves 5, 7 of the first 19 and second module 20 coplanar.

Furthermore, so as to facilitate the grip of the truncated cone element 9 by the user, a plurality of ribs 12 is provided that extend along the external surface of the truncated cone element 9.

The conical shape of the truncated cone element provides a larger surface area on which the shelving system can rest giving greater stability to the whole structure and more uniform distribution of forces across the support plane.

The value of the conicity is particularly suitable to allow the modules of the shelving system to be placed alongside one another. In fact, the truncated cone element does not project outside the perimeter of the bottom shelves 4, 6 leading to a smaller dimension and facilitating the positioning of the shelving system modules alongside one another.

The adjustment means further comprise an adaptor ring 17 substantially for adapting the dimensions of the diameter of the cylindrical element 10 to the dimensions of the diameter of the through holes present in the bottom shelves 4, 6. Advantageously the cylindrical element 10 and the ring 17 have mutual retaining means.

The retaining means comprise a plurality of housing seats 21 positioned outside the cylindrical element 10 and a plurality of protuberances 22 positioned on a surface of the ring 17 in contact with the cylindrical element 10.

Advantageously there are also mutual retaining means between the ring 17 and the uprights 3 of exactly the same type as the mutual retaining means provided between the ring 17 and the cylindrical element 10. In particular, various rows of housing seats 21 are provided at various heights along the uprights 3 so as to finely adjust the position of the shelves and compensate for any misalignments between the shelves of adjacent modules.

Furthermore the ring 17 has a cut 18 parallel to its axis S that extends along the whole length of the wall of the ring and facilitates the elastic engagement of the protuberances 22 with the respective housing seats 21 thus allowing a stable and secure coupling between the ring 17 and the cylindrical element 10.

The adaptor ring 17 is inserted onto the cylindrical element 10 when the diameter of the through hole 24 of the bottom shelves 4, 6 is larger than the diameter of the cylindrical element.

Figure 7:
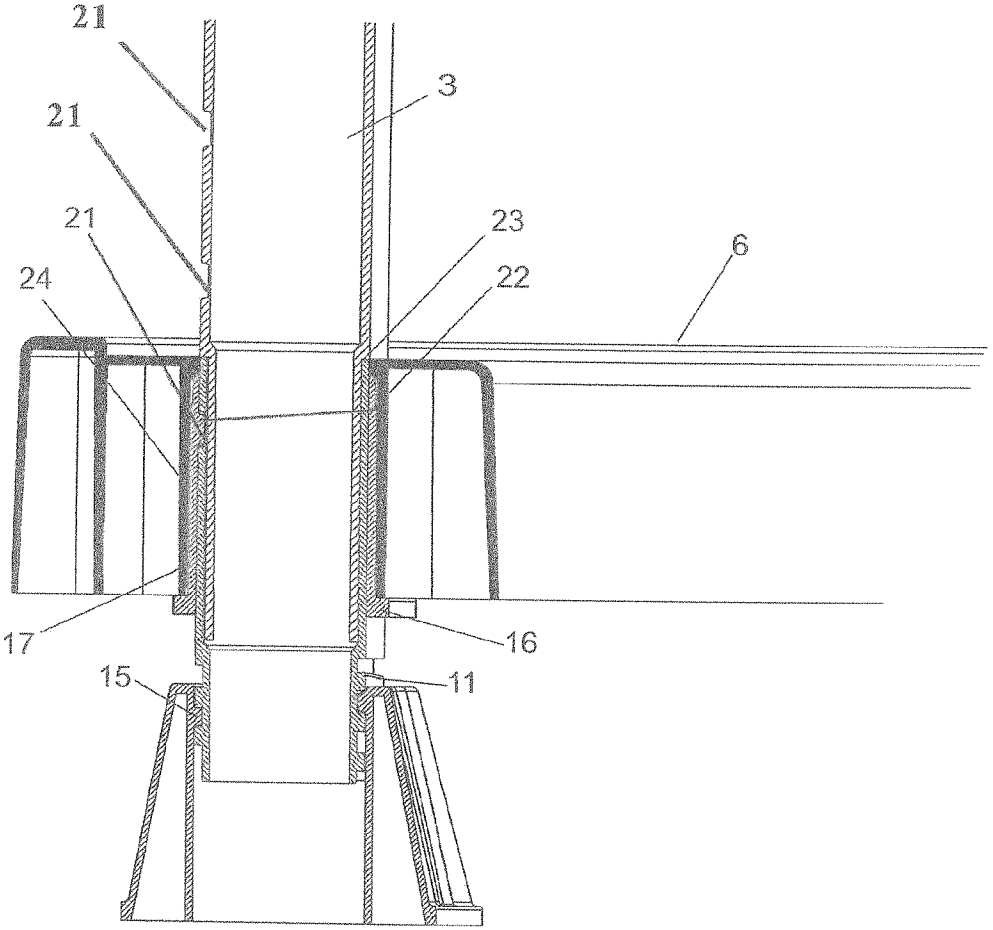
FIG. 7 shows a sectional view of the adjustment means in compliance with a second embodiment of the invention.
Figure 8:
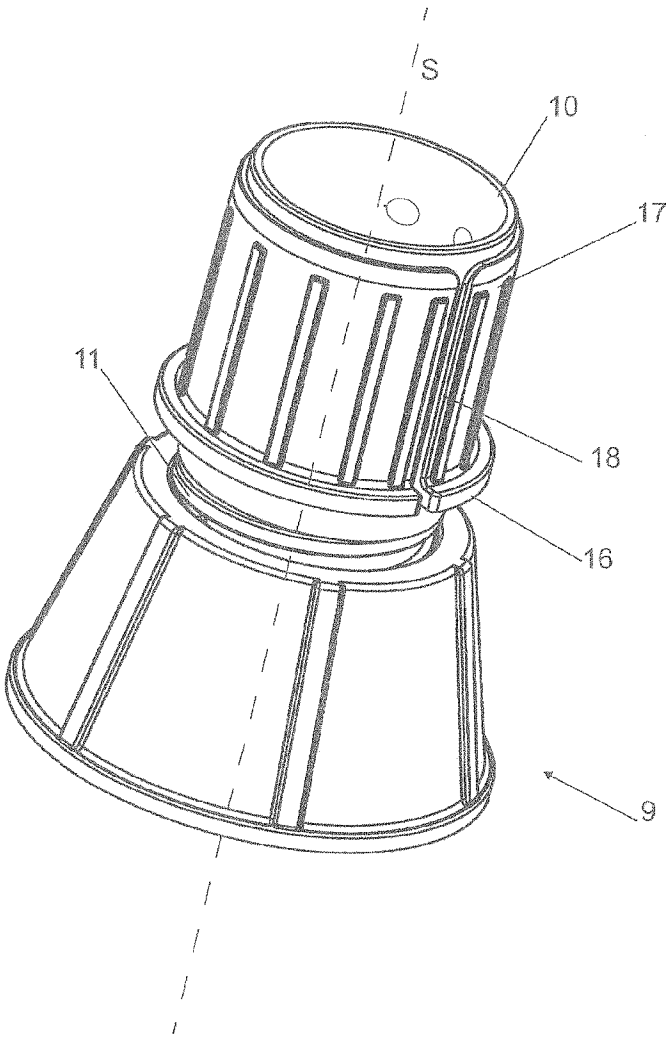
FIG. 8 shows a perspective view of the adjustment means.

In fact, the ring 17 has a collar 16 connected to it with a lateral surface adapted to give greater strength to the collar 16 for the connection with the bottom shelves 4, 6 which, as shown in FIG. 7, rest directly on the collar 16.

Figure 5:
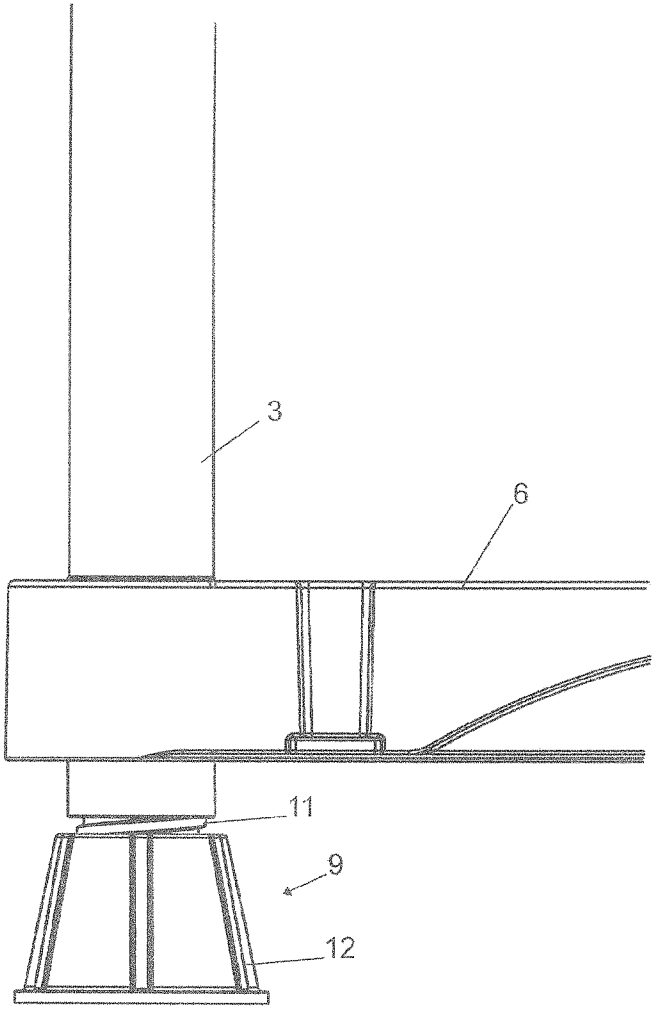
FIG. 5 shows a view of a detail of the second module of the shelving system according to a first embodiment of the invention.
Figure 6:
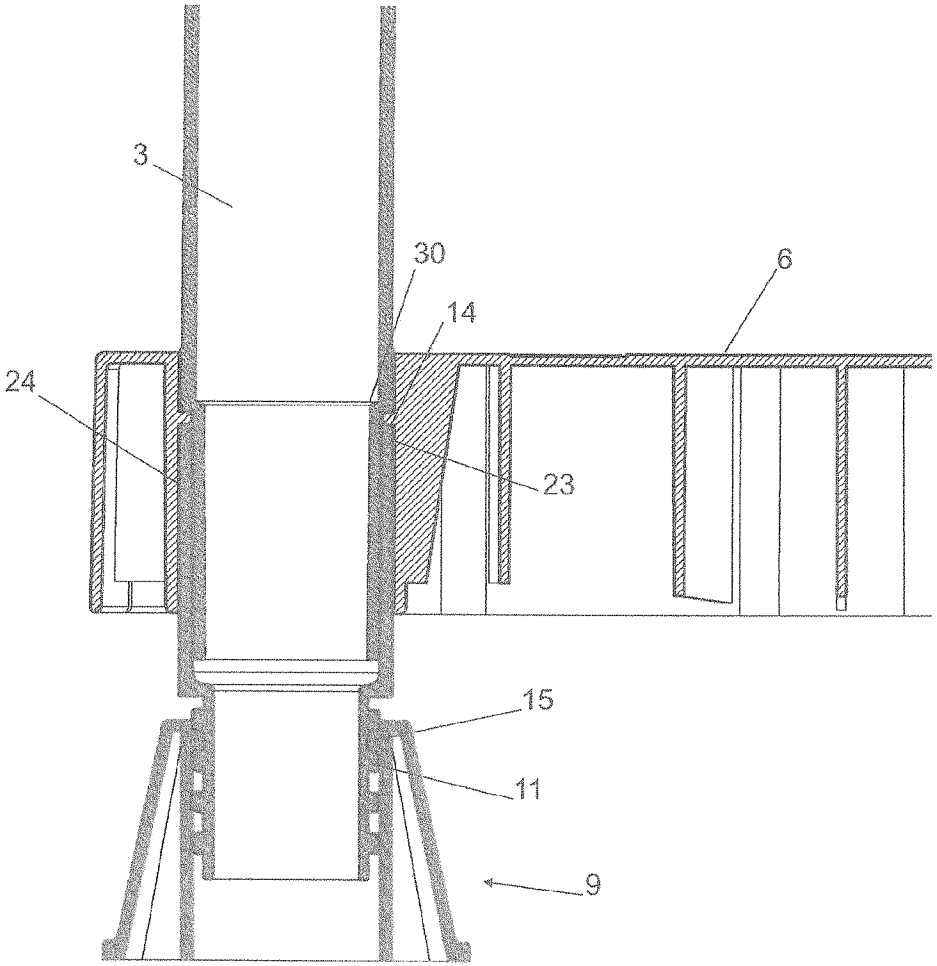
FIG. 6 shows a sectional view of the detail of FIG. 5.

In the case illustrated by way of example in FIGS. 5 and 6, the diameter of the through hole 24 in the bottom shelves 4 and 6 is substantially the same size and the diameter of the cylindrical element 10.

In this embodiment, the second end 23 of the cylindrical element 10 engages with an annular flange 14 internal to the through holes 24 in the bottom shelves 4, 6. In this way, the bottom shelves rest directly on the cylindrical element 10, without needing to insert the adaptor ring 17.

The annular flange 14 is clamped between the second end 23 of the cylindrical element 10 and the external shoulder 30 of the uprights 3.

The modular shelving system in compliance with the present invention definitively allows the user to compose shelving with various modules also with an extremely stable longitudinal extension, with a high load capacity and aesthetically pleasing.

The dimensions may in practice be of any type according to requirements and the state of the art.

The invention claimed is:

1. A modular shelving system, comprising:

at least one first module comprising supporting feet, a bottom shelf, a top shelf, and a plurality of uprights, wherein a corresponding supporting foot is connected to the bottom shelf and the top shelf by a corresponding upright, wherein each of said feet comprises an adjustment element configured to permit horizontal leveling of said bottom shelf and said top shelf so that each of said uprights can be loaded with a peak or axial load so as to reach a capacity of said shelving system that is substantially equal to a nominal design load thereof, wherein each adjustment element comprises a truncated cone element adapted to rest on a support plane and a cylindrical element which is structurally independent from said truncated cone element, each cylindrical element comprising a first end adapted to be screwed and threadingly engage within an interior surface of a corresponding truncated cone element and a second end opposite the first end, wherein each second end is adapted to releasably engage a corresponding upright in a sleeved manner, wherein each adjustment element further comprises an elastically yielding adaptor ring for adapting the dimensions of the diameter of said cylindrical element to the dimensions of a diameter of corresponding through holes in said bottom shelf, said adaptor rings being elements of said feet and structurally independent from said truncated cone elements and said cylindrical elements, wherein each cylindrical element comprises a first set of retaining elements and each adaptor ring comprises a second set mating retaining elements adapted to mate with a corresponding first set retaining elements of a corresponding cylindrical element, wherein each first set of retaining elements comprises a plurality of housing seats formed on an exterior of each cylindrical element and each second set of mating retaining elements comprises a plurality of protuberances positioned on an interior surface of each adaptor ring, wherein a corresponding protuberance elastically engages and is inserted within a corresponding housing seat to secure a corresponding adaptor ring to the corresponding cylindrical element, wherein each adaptor ring has a cut parallel to its axis (S) along the whole length of each adaptor ring, wherein the cuts are configured to facilitate the elastic engagement of said protuberances with said housing seats, and wherein each adaptor ring comprises a collar protruding from an exterior surface of each adaptor ring, each collar having a lateral surface.

2. The shelving system according to claim 1, further comprising, a second module alongside said at least one first module, said second module comprising supporting feet, a bottom shelf, a top shelf, and a plurality of uprights, wherein a corresponding supporting foot is connected to the bottom shelf and the top shelf by a corresponding upright, wherein each foot comprises an adjustment element configured to make said top shelf of said first module coplanar with said top shelf of said second module when in said first or second module there is a middle shelf between the respective bottom shelf and the respective top shelf.

3. The shelving system according to claim 1, wherein each truncated cone element comprises an internal thread corresponding to half a turn of a screw.

4. The shelving system according to claim 3, wherein each first end of each cylindrical element comprises an external counter-thread adapted to be screwed into a corresponding internal thread of a corresponding truncated cone element.

5. The shelving system according to claim 1, wherein each truncated cone element comprises a plurality of non-slip ribs formed on an exterior surface of each truncated cone element.

6. The shelving system according to claim 1, wherein each of said uprights comprises a third set of retaining elements and each adaptor ring comprises a fourth set of mating retaining elements adapted to mate with a corresponding third set of retaining elements of a corresponding upright.

7. The shelving system according to claim 1, wherein the second end of each cylindrical element engages with an annular flange internal to a corresponding through hole in said bottom shelf.

8. The shelving system according to claim 7, wherein each flange is clamped between a corresponding second end of a corresponding cylindrical element and an external shoulder of a corresponding upright.

* * * * *